US006698667B2

(12) United States Patent
Klempel et al.

(10) Patent No.: US 6,698,667 B2
(45) Date of Patent: Mar. 2, 2004

(54) NOZZLE BEAM FOR COOLING OR DESCALING METAL STRAND MATERIAL, PARTICULARLY ROLLING STOCK

(75) Inventors: Dankfried Klempel, Mülheim (DE); Heinz-Peter Schmitz, Ratingen (DE); Dirk Schmidt, Mettmann (DE)

(73) Assignee: SMS Demag AG, Düsseldorf (DE)

( * ) Notice: Subject to any disclaimer, the term of this patent is extended or adjusted under 35 U.S.C. 154(b) by 11 days.

(21) Appl. No.: 09/863,796

(22) Filed: May 23, 2001

(65) Prior Publication Data

US 2002/0011528 A1 Jan. 31, 2002

(30) Foreign Application Priority Data

May 24, 2000 (DE) ..... 100 25 639

(51) Int. Cl.[7] ..... B05B 1/24; B05B 15/00; B05B 1/30

(52) U.S. Cl. ..... 239/128; 239/132.5; 239/569; 239/570

(58) Field of Search ..... 239/128, 132.5, 239/533.1, 533.15, 569, 570, 754; 137/563, 565; 251/118; 72/39, 38, 40, 41, 42–45, 201, 202; 134/174, 176, 181, 183

(56) References Cited

U.S. PATENT DOCUMENTS

| | | | | | |
|---|---|---|---|---|---|
| 3,881,337 | A | * | 5/1975 | Cofer et al. | 72/45 |
| 4,233,830 | A | * | 11/1980 | Houdion | 72/38 |
| 5,001,915 | A | * | 3/1991 | Blazevic | 72/39 |
| 5,263,504 | A | * | 11/1993 | Bailey et al. | 134/176 |
| 5,460,023 | A | * | 10/1995 | Ginzburg | 72/43 |
| 5,794,658 | A | * | 8/1998 | Saikin | 137/563 |

* cited by examiner

*Primary Examiner*—Davis D Hwu
(74) *Attorney, Agent, or Firm*—Friedrich Kueffner

(57) ABSTRACT

A nozzle beam for descaling or cooling metal strand material, particularly rolling stock, includes an inlet for the product treatment liquid and an additional inlet for a device cooling liquid, an outlet for the device cooling liquid, and a switching member for opening and closing the device cooling liquid outlet. The switching member is automatically switchable through a device cooling liquid pressure which controls the state of operation of the nozzle beam.

10 Claims, 3 Drawing Sheets

1
2
3
4
5
6
7
8
9a
9b
10
10a
10b
11
12
13
14
15
16
21

NOZZLE BEAM FOR COOLING OR DESCALING METAL STRAND MATERIAL, PARTICULARLY ROLLING STOCK

BACKGROUND OF THE INVENTION

1. Field of the Invention

The present invention relates to a nozzle beam for descaling or cooling metal strand material, particularly rolling stock. The nozzle beam includes an inlet for the product treatment liquid and an additional inlet for a device cooling liquid and an outlet for the device cooling liquid and a switching member for the outlet for opening and closing the device cooling liquid outlet.

2. Description of the Related Art

DE-OS 34 33 712 discloses a cooling water outlet in a device for producing a water curtain for cooling sheets or strips which are moved through the water curtain, wherein the cooling water outlet includes a water box with a slot-shaped nozzle extending over the width of the strand material transversely of the direction of movement of the sheets or strips. A siphon pipe is provided laterally next to the slot-shaped nozzle for discharging the continuously supplied cooling water, wherein the inlet opening of the siphon pipe is arranged below the inlet opening of the slot-shaped nozzle and its siphon and discharge opening are arranged below the discharge opening of the slot-shaped nozzle. A device of this kind has the disadvantage that the cooling water continues to be conducted through the nozzle beam and the cooling water is applied to and cools the rolling stock even when only the cooling device itself is to be cooled or protected and the rolling stock no longer requires cooling.

In the past, two separate chambers were required for the functions "product treatment" and "cooling of the device" or at least a switching member with a separate energy supply in the case of an electrical control and a corresponding signal processing means were required.

The cooling water is usually required for protecting the cooling device itself when it is "out of operation" against excessive heating and any resulting damage. For changing between "out of operation" and "in operation" the above-mentioned switching member with an appropriate control command is necessary in order to switch on or off the cooling water required for the cooling device.

SUMMARY OF THE INVENTION

It is the primary object of the present invention to provide a nozzle beam in which, during the time that the supply of product treatment liquid is switched off, the necessary cooling of the treatment or cooling device itself is maintained while the strand product travels through the nozzle beam.

In accordance with the present invention, in the nozzle beam of the above-described type, the switching member is automatically switchable through a device cooling liquid pressure which controls the state of operation.

As a result of the configuration according to the present invention, the treatment liquid outlet is automatically closed or later again opened on the basis of a pressure in the treatment liquid which is changed for this state of operation. The device itself is protected during all phases of operation in spite of the thermal radiation of the strand material. The structure of the device is simplified because only one chamber is required for the treatment liquid.

In accordance with a further development of the invention, the basic concept of the invention makes it possible that through an increased cooling liquid pressure the switching member can switch off the quantity of cooling liquid necessary for cooling the device.

In accordance with another improvement provided by the invention, a closing or valve member is arranged in a housing in the area of the device cooling liquid outlet in such a way that the closing or valve member is in the flow path of the device cooling liquid and can be actuated by the device cooling liquid. This makes it possible to provide the switching member with the described properties in close vicinity to the nozzle beam. Simultaneously, the nozzle beam becomes very compact, so that no additional space is required.

In accordance with an advantageous feature, the closing or valve member is composed of a conical or spherical body mounted in the housing with guide portions at both ends. The liquid can easily flow around the conical body or the spherical body.

In accordance with another feature, the closing or valve member is adjustable against the force of a compression spring which coaxially surrounds a front guide portion of the closing or valve member. Consequently, the closing or valve member is held open against closing as a result of a restoring force.

The restoring force of the closing or valve member can also be derived from its own weight, either alone or in combination with the compression spring.

In accordance with another development, a cooling liquid discharge pipe is connected in front of and following the closing or valve member in the direction of the flow path of the device cooling liquid to the front guide portion which is surrounded by a liquid space. When the strand material cooling or descaling unit is switched on, the increase of the liquid pressure in the nozzle beam and the resulting increase of the flow velocity produces a pressure drop in the area of the closing or valve member which overcomes the restoring force and presses the closing or valve member in a closed position.

A secure closing action is achieved by arranging a seat ring with a closing edge for the closing or valve member with conical body in the housing at the inlet opening of the device cooling liquid space. The seat ring with closing edge may be of cylindrical or conical construction. The same operation is achieved in the case of a spherical body or partially spherical body as the closing or valve member. When the supply of product treatment liquid is switched off, the reduced pressure in the nozzle beam makes it possible for the restoring force to move the closing or valve member out of the seat ring and to once again open up the device cooling liquid outlet.

The geodetic highest level of the treatment liquid outlet must be selected in such a way that the closing or valve member and the free outlet are arranged below the geodetic level of the product treatment liquid and the overflow pipes thereof. Consequently, the lower portion of the nozzle beam remains filled with device cooling liquid while the overflow for the product treatment liquid at a higher level is not reached, and thus, device cooling liquid does not flow onto the strand material when the supply of product treatment liquid is switched off.

The device cooling liquid is supplied through an adjusting member and/or a check valve in a defined quantity which corresponds to the structural size of the cooling liquid outlet, the required liquid quantity, the structural unit and the operation of the closing or valve member. This makes it possible to take the device cooling liquid from the product treatment liquid supply while bypassing the closed inlet of the product treatment liquid. A check valve is not required in this arrangement. If the device cooling liquid is supplied from a separate supply with a low pressure, the check valve is usually provided in order to lock the flow into the device cooling liquid supply system when the supply of treatment liquid is switched on.

The various features of novelty which characterize the invention are pointed out with particularity in the claims annexed to and forming a part of the disclosure. For a better understanding of the invention, its operating advantages, specific objects attained by its use, reference should be had to the descriptive matter in which there are described preferred embodiments of the invention.

DESCRIPTION OF THE PREFERRED EMBODIMENTS

Figure 1:
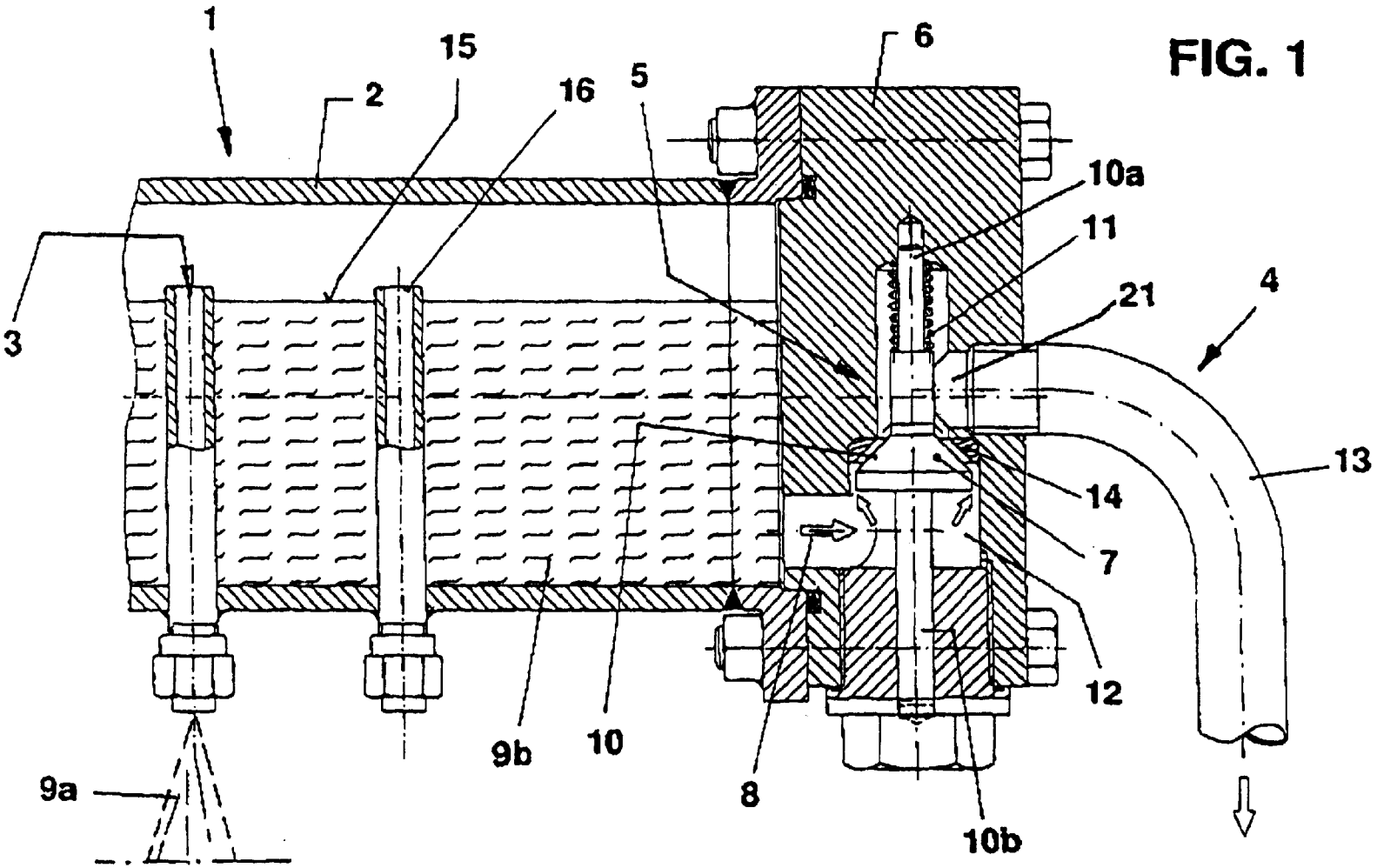
FIG. 1 is a partial axial sectional view of the nozzle beam according to the present invention showing the area of the device cooling liquid outlet.

As illustrated in FIG. 1 of the drawing, the nozzle beam 1 is composed of a flood pipe 2 and includes a device cooling liquid outlet 4. The nozzles of the nozzle beam 1 may be in the form of nozzle pipes, as shown in the drawing, or of slots or other openings.

Figure 2:
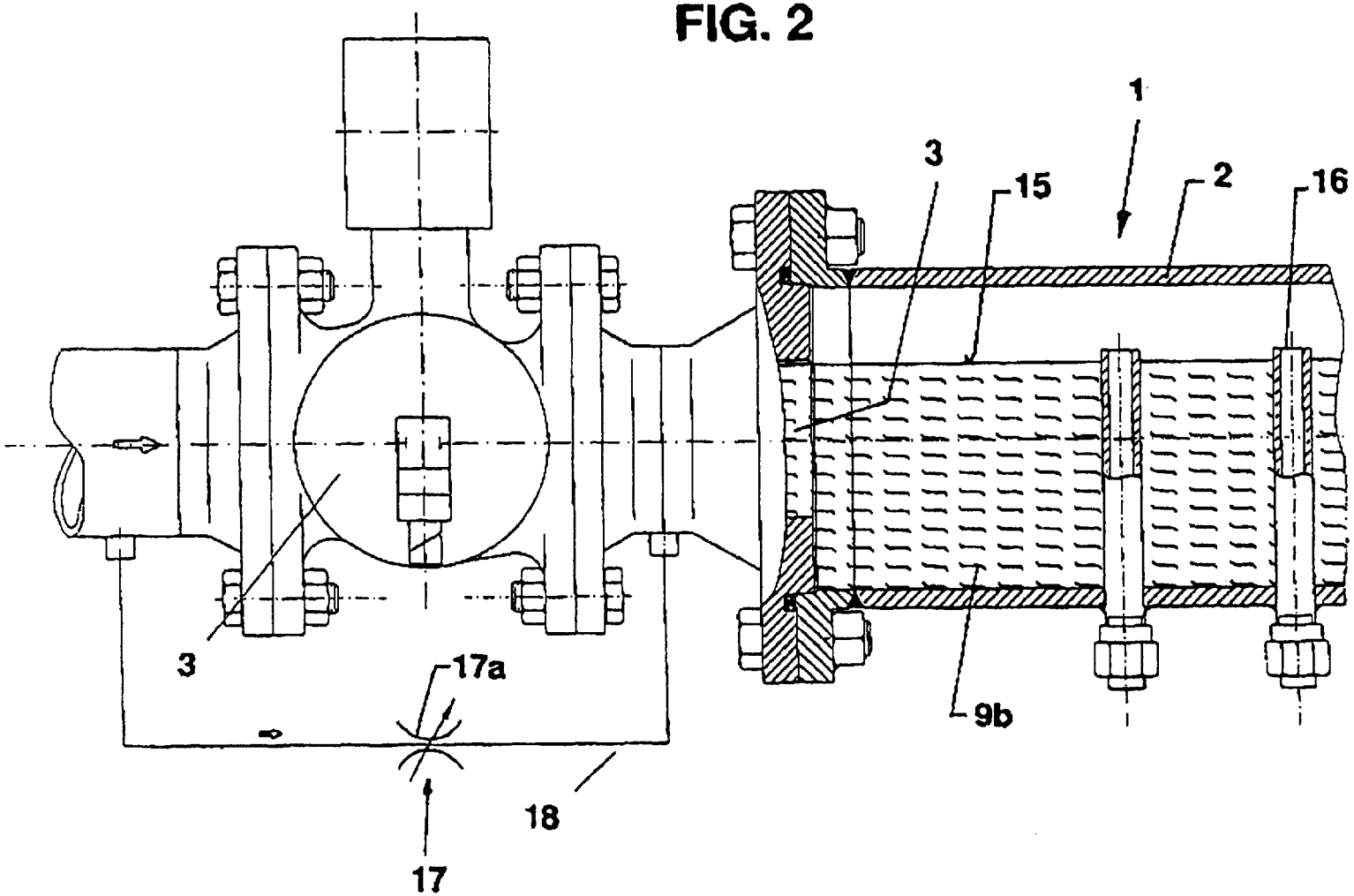
FIG. 2 is a partial axial sectional view of the nozzle beam in the area of the product treatment liquid supply with a pipe for bypassing the product treatment liquid supply and with an additional quantity control for the device cooling liquid.
Figure 3:
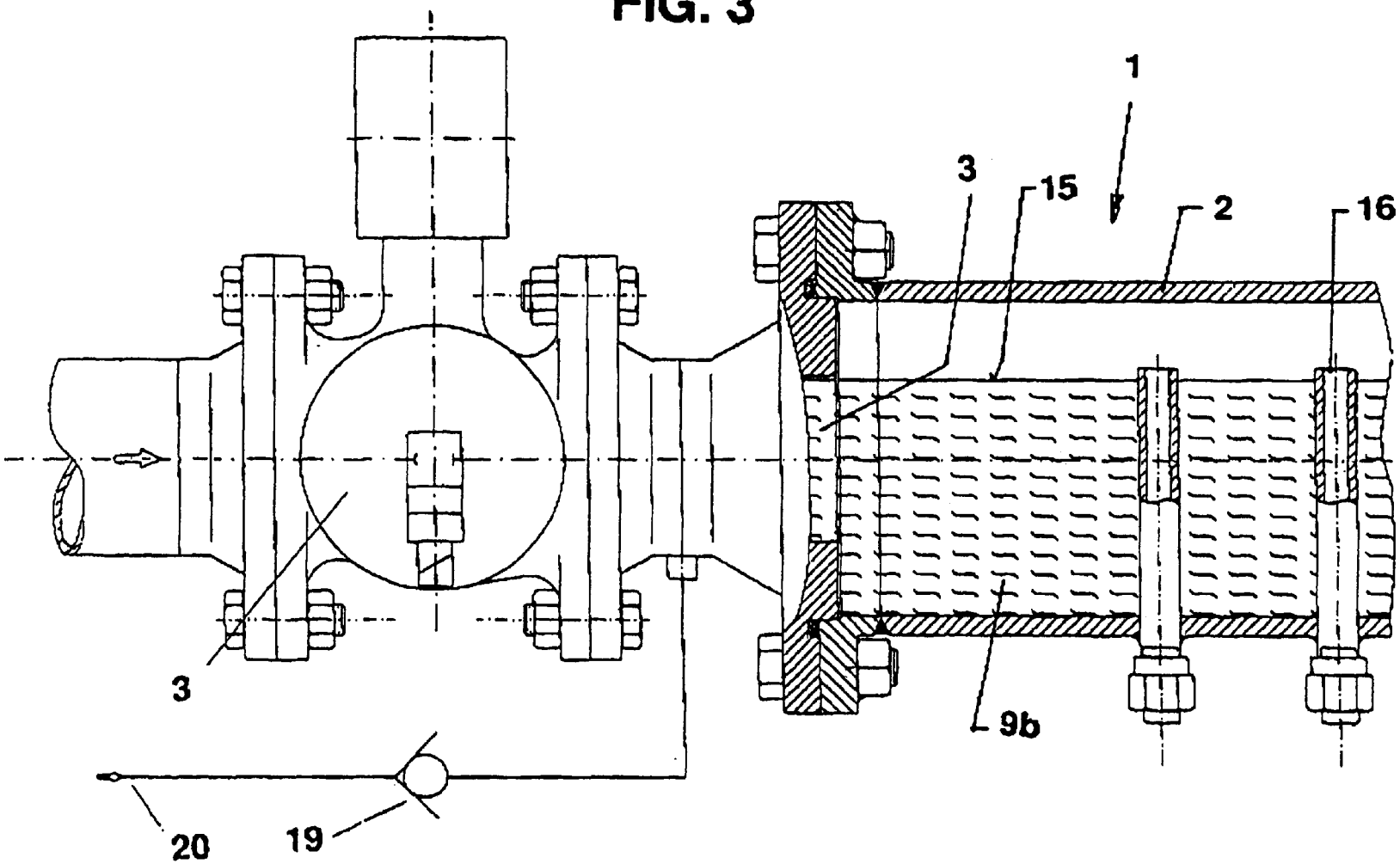
FIG. 3 is a partial axial sectional view of the nozzle beam, as in FIG. 2, but with a supply of the device cooling liquid from a separate source.

The product treatment liquid inlet 3 for the product treatment liquid 9*a* can be seen in FIGS. 2 and 3.

A switching member 5 for the device cooling liquid 9*b* is arranged on the side of the device cooling liquid outlet 4. The switching member 5 is switched through a pressure which controls the state of operation. In the illustrated embodiment, the switching member 5 is switched off through an increased pressure. A housing 6 is tightly flanged to the area of the device cooling liquid outlet 4. In the housing 6, cooling liquid 9*b* flows in a flow path 8 against a valve member 7. The valve member 7 has a middle conical body 10 and guide portions 10*a* and 10*b* are connected to both ends of the body 10. The guide portions 10*a* and 10*b* are slidingly mounted in the housing 6. Instead of the conical body 10, it is also possible to use a spherical body or a partially spherical body. The valve member 7 is adjustable against the force of a compression spring 11 which is placed on the front guide portion 10*a* and against a step in the bore of the housing 6 and against a step of the front guide portion 10*a*. Instead of using the compression spring 11, or in combination with the compression spring 11, it is also possible to derive the restoring force of the vertically arranged valve member 7 from the weight of the valve member. A cooling liquid space 12 is formed in the flow path 8 of the device cooling liquid 9*b* in front of the valve member 7 and around the front guide portion 10*a*. A cooling liquid discharge pipe 13 is connected to the cooling liquid space 12. The flow path 8 extends between a conical seat ring 14 with closing edge arranged at the outlet of the cooling liquid space 12 for the closing member 7 in the form of a conical body 10 in the housing 6 and the conical body 10.

FIG. 2 of the drawing shows the product treatment liquid supply 3 as well as a device cooling liquid supply 18. The valve member 7 shown in FIG. 1 is arranged below the geodetic level 15 and below overflow pipes 16 for the product treatment liquid 9*a*. Consequently, the device cooling liquid outlet 4 is selected at the geodetic level of its highest point, so that the lower portion of the nozzle beam 1 remains filled with device cooling liquid 9*b*, wherein, however, the overflow pipes 16 for the device cooling liquid 9*b* located at a higher level are not reached and, thus, no liquid is admitted to the strand material, such as rolling stock, for example, strip material, when the supply of product treatment liquid 9*a* is switched off.

The device cooling liquid inlet 18 of the product treatment liquid inlet 3 delivers a defined quantity which corresponds to the structural size of the device cooling liquid outlet 4, the required quantity of cooling liquid per unit of time, the structural unit and the function of the valve member 7, wherein the quantity of device cooling liquid 9*b* is supplied in a bypass through an upstream adjusting member 17, for example, a throttle member 17*a*.

Another embodiment is illustrated in FIG. 3. The device cooling liquid 9*b* is supplied from a separate device cooling liquid supply 20 at low pressure. It is of no consequence from which circuit the device cooling liquid 9*b* is taken. For descaling, usually regular water is used in the hot area at high pressures, for example, 100–200 bar, and up to 400 bar, in appropriate quantities. For this purpose, usually the check valve 19 is provided in order to lock the return flow into the device cooling liquid supply 20 when the supply of product treatment liquid 9*a* is switched on.

While specific embodiments of the invention have been shown and described in detail to illustrate the inventive principles, it will be understood that the invention may be embodied otherwise without departing from such principles.

We claim:

1. A nozzle beam for descaling or cooling metal strand material, particularly rolling stock, the nozzle beam comprising a plurality of nozzles for directing product treatment liquid toward the metal strand material, an inlet for the product treatment liquid and an additional inlet for a device cooling liquid, an outlet for the device cooling liquid, and a switching member for opening and closing the device cooling liquid outlet, wherein the switching member is configured to be automatically switchable through an increased product treatment liquid pressure such that the device cooling liquid outlet is closed and the product treatment liquid is discharged through the nozzles toward the metal strand material.

2. The nozzle beam according to claim 1, wherein the switching member is configured to switch off through an increased cooling liquid pressure a quantity of cooling liquid necessary for cooling the nozzle beam.

3. The nozzle beam according to claim 1, comprising a housing in an area of the device cooling liquid outlet, the housing defining a flow path for the device cooling liquid, further comprising a valve member in the flow path configured to be actuated by the device cooling liquid.

4. The nozzle beam according to claim 3, wherein the valve member is comprised of a conical or spherical body having front and rear guide portions connected to the body, wherein the guide portions are supported in the housing.

5. The nozzle beam according to claim 4, further comprising a compression spring coaxially surrounding the front guide portion, wherein the valve member is configured to be adjustable against a force of the compression spring.

6. The nozzle beam according to claim 4, comprising a cooling liquid discharge pipe connected in front of and following the valve member in a direction of the flow path of the device cooling liquid to the front guide portion, and wherein the front guide portion is surrounded by a liquid space.

7. The Nozzle beam according to claim 6, comprising a seat ring with a closing edge for the valve member having a conical body mounted in the housing at an inlet opening of the liquid space.

8. The nozzle beam according to claim 3, wherein the valve member is mounted essentially vertically, so that a weight of the valve member produces a restoring force of the valve member.

9. The nozzle beam according to claim 3, wherein the valve member and the device cooling liquid outlet are arranged below a geodetic level of the product treatment liquid and overflow pipes therefor.

10. The nozzle beam according to claim 1, comprising at least one of an adjusting member and a check valve mounted upstream of the nozzle beam for supplying the device cooling liquid in a defined quantity corresponding to a structural size of the cooling liquid outlet, a required cooling liquid quantity, a structural configuration of the nozzle beam and an operation of the valve member.

* * * * *